United States Patent [19]

Kuioka et al.

[11] Patent Number: 4,945,661

[45] Date of Patent: Aug. 7, 1990

[54] DREDGING APPARATUS

[75] Inventors: Kiyoshi Kuioka; Ryoichi Yamamoto; Koji Inaba; Toyoma Hoshino, all of Yamaguchi, Japan

[73] Assignee: Ube Industries, Ltd., Ube, Japan

[21] Appl. No.: 390,276

[22] Filed: Aug. 7, 1989

[30] Foreign Application Priority Data

Nov. 29, 1988 [JP] Japan ..... 63-299444
Mar. 17, 1989 [JP] Japan ..... 1-63478

[51] Int. Cl.[5] ..... E02F 3/92

[52] U.S. Cl. ..... 37/67; 37/65; 37/189; 37/DIG. 7; 406/50; 406/57; 406/60; 406/61; 406/93

[58] Field of Search ..... 37/64–68, 37/189, DIG. 7; 406/57, 58, 59, 60, 61, 50, 93, 113, 141

[56] References Cited

U.S. PATENT DOCUMENTS 364,571 6/1887 Bowers ..... 37/67
2,467,682 4/1949 Megargee ..... 37/67 X
3,885,330 5/1975 Araoka ..... 37/64 X
3,994,082 11/1976 Faldi ..... 37/71
4,312,762 1/1982 Blackburn et al. ..... 37/64 X
4,386,473 6/1983 Amann et al. ..... 37/58 X

FOREIGN PATENT DOCUMENTS 1204901 6/1986 U.S.S.R. ..... 37/58

*Primary Examiner*—Randolph A. Reese
*Assistant Examiner*—Arlen L. Olsen
*Attorney, Agent, or Firm*—Kanesaka and Takeuchi

[57] ABSTRACT

Mud is taken into a vertical screw conveyor while an inlet device is rotating or without the use of such an inlet device. The mud is sent from the discharge port of the conveyor into a transport pipe. The mud is forcibly sent by a compressed air. Screens are provided to take only the mud into the screw conveyor. Paddles for stirring mud are provided on the vanes of the screw. A check valve and/or a pressure feeder (transport pump) is provided between the discharge port of the conveyor and the transport pipe.

6 Claims, 10 Drawing Sheets

1
2
3
4
4a
5
6
7
8
9
10
11
12
13
14
15
16
17
18
19
20
21
22
24
24a
25

DREDGING APPARATUS

FIELD OF THE INVENTION

This invention relates to a dredging apparatus which is used in dredging up soft mud, such as sludge, accumulating on the bottom of the sea, intake channel (of a power plant ), lake, marsh, river, bay, etc. This invention also relates to a dense dredging and air injecting apparatus which is used both in dredging up and transporting mud continuously at high density and in sucking up and transporting mud continuously from a sediment carrying vessel having dredged up and collected mud.

RELATED ART

Conventionally, the dredging-up of soft mud, such as sludge, accumulating on the seabed and the like is performed by putting a submergible pump in a soft mud layer and sucking up soft mud.

A conventional pump-type dredging apparatus comprises a large-capacity pump mounted on a vessel or the like and uses a hose extending from the pump up to the bottom of the sea, lake, etc, so that both soft mud and water are sucked up.

Where a mud sucking pump is used to dredge up and transport soft mud, such as sludge, accumulating on the bottom of the water, the pump is operated to suck up muddy water while swinging a suction portion ( an intake portion ) about the bottom of the water, and the thus sucked muddy water is transferred through a pipe line or via a carrying vessel to a disposal area such as a dumping site. At the dumping site, a solidifying agent or coagulating agent is added to promote solidification.

Where a submergible pump is used to perform dredging, since it cannot dredge up dense soft mud, soft mud is sucked up together with sea water; thus, the efficiency of dredging is low, and an elaborate device must be used to handle the sea water thus sucked, increasing expense. That is, in the case of the conventional dredging apparatus, the volume of water sucked concurrently with soft mud is excessive; therefore, a solidifying agent cannot be mixed until such excessive water is handled. The reason will be described in greater detail.

In the case of the pump of the prior art dredging exclusive of floating mud or the like having a small specific gravity and exhibiting a fluidity very similar to that of the water, water paths are generally created during dredging a soft mud layer around the suction portion of the pump, that is formed by removing soft mud accumulating on the bottom of the water, a lot of water enters the suction portion through such water paths, and much water together with little soft mud is sucked into the pump; thus, dense soft mud cannot be dredged up continuously.

When changing the position of a spud ( a pile ) of a pump vessel to change a dredging point, a suction head cannot change its position because the pump vessel is stationary, the suction head performs a suction operation in the area where soft mud has been taken out already, and much water is sucked up, thereby lowering the efficiency of dredging. That is, the density of soft mud decreases, and virtually water only is sucked up. Since the pump is designed to suck up and eject mud, if it is stopped, an ejection pipe is filled and clogged with mud through deposit; thus, the pump cannot be stopped, thereby inevitaly continuing to send water.

Thereafter, with the pump used for dredging, the efficiency of dredging is poor, the volume of water sucked is large compared with the volume of mud dredged, a large expense is needed to handle muddy water, and a wide disposal area is required.

Another dredging method of the prior art is to scoop up soft mud from the seabed using a grab bucket. In the case of a grab bucket operation, soft mud on the bottom of the water is scooped up and loaded onto a sediment carrying vessel by means of the grab bucket, the sediment carrying vessel is towed to a pier after it is fully loaded, the mud loaded on the sediment carrying vessel is unloaded by means of a construction machine such as a backhoe, and then it is transported to a disposal area through truck transportation. In this case of the dredging method using the grab bucket, sea water becomes turbid, thereby causing a problem of secondary pollution.

That is, in the case of the grab dredging, since soft mud is scooped up by throwing down the grab bucket onto the bottom of the water, a large underwater zone becomes turbid and this spreads, thereby disturbing sea environment. Thus, a curtain must be installed to prevent turbidity from spreading, thereby incurring an additional large expense.

SUMMARY OF THE INVENTION

It is an object of the present invention to provide a dredging apparatus capable of dredging up soft mud at high density with a small-sized spill-water handling facility.

It is another object of the present invention to provide a dredging apparatus capable of dredging first an inner portion of a soft mud layer not its surface portion so that no turbidity generates and no secondary pollution results.

It is a further object of the present invention to provide a dredging apparatus capable of transferring soft mud for a long distance smoothly through an ejection pipe by introducing compressed air in the vicinity of the discharge port of a vertical screw conveyor or into the ejection pipe.

It is a further object of the present invention to provide a dredging apparatus capable of a ejecting soft mud strongly because of the inclusion of an ejecting pump.

It is a further object of the present invention to provide a dredging apparatus which includes a rotatable plow equipped with scooping blades and screens and provided on the distal end side of a screw conveyor, and stirring paddles for promotion of fluidity so that the efficiency of taking soft mud into the screw conveyor increases, foreign matters are prevented from entering the screw conveyor, and a smooth operation of the screw conveyor is ensured.

It is a further object of the present invention to provide a dredging apparatus capable of dredging first an inner portion of a soft mud layer so that little turbidity is generated and sea environment is not degraded.

It is a further object of the present invention to provide a dredging apparatus capable of interrupting a dredging operation or a mud sucking operation when changing the position of a spud of a dredging vessel ( to move the dredging vessel ) because a dredging ( mud sucking ) function is independent of a transporting function so that little spill-water is sucked in.

A dredging apparatus according to a feature of the present invention comprises a vertical screw conveyor, an inlet device provided rotatably on the distal end side of the vertical screw conveyor, a transport pipe provided at a discharge port of the vertical screw conveyor, and a nozzle for introducing compressed air into the transport pipe. In this dredging apparatus, a lower end portion of the vertical screw conveyor and the inlet device are put through a soft mud layer, the inlet device promotes the fluidity of the soft mud layer, the screw takes in soft mud, the vertical screw conveyor sends dense soft mud upward, the soft mud is discharged through the discharge port into the transport pipe, and then it is transferred through the transport pipe onto the ground or into a vessel. In this operation, if compressed air is introduced into the transport pipe, the soft mud flows inside the transport pipe in the form of "plug flow", so that the soft mud can be transferred smoothly for a long distance. This dredging apparatus may further include a transport pump for pressure increasing (such as a centrifugal pump etc.) that means a pressure feeder provided between the discharge port of the vertical screw conveyor and the transport pipe. In this case, the soft mud can be transferred very strongly by means of energy of compressed air without flow-back of air toward upstream because of transport pump.

A dredging apparatus according to another feature of the present invention comprises a vertical screw conveyor, a transport pump connected with a discharge port of the vertical screw conveyor, a transport pipe connected with the discharge port of the transport pump, and a nozzle for introducing compressed air into the transport pipe. This dredging apparatus has no inlet device, but includes the transport pump; thus, the soft mud can be transferred strongly.

A dredging apparatus according to a further feature includes a plow provided rotatably on the distal end side of a vertical screw conveyor, this plow comprising a plurality of screens spaced vertically at given intervals, scooping blades integrally attached to the screens in crossing relation thereto, and stirring paddles projecting from screw vanes provided in a lower portion of the screw conveyor. In this dredging apparatus, soft mud around an intake portion is stirred, softened, and fluidized in response to the rotation of the plow, and is taken into the vertical screw conveyor by means of the scooping blades. The soft mud reaching inside the screw conveyor is further fluidized by means of the stirring paddles attached to the screw vanes and given a rising faculty by means of the screw vanes, thereby being transferred to the discharge side.

A dredging apparatus according to a further feature comprises a vertical screw conveyor, an inlet device provided rotatably on the lower end side of the vertical screw conveyor, a check valve provided at a discharge port of the screw conveyor, a transport pipe provided on the discharge side of the check valve, and a nozzle for introducing compressed air into the transport pipe. In this case, a pressure feeder (transport pump) may be provided between the discharge port of the vertical screw conveyor and the check valve. Further, at least one mud stirring device may be provided near the periphery of the lower end of the vertical screw conveyor. In this dredging apparatus, a lower end portion of the vertical screw conveyor and the inlet device are put through a soft mud layer. Starting from an inner portion, the soft mud layer is smashed and fluidized by means of the inlet device, taken in by means of the screw, sent up at high density by means of the vertical screw conveyor, and ejected through the discharge port of the vertical screw conveyor, check valve and transport pipe onto the ground or into a vessel. In this operation, if compressed air is introduced into the pipe, the soft mud flows inside the pipe in the form of "plug flow" and thus is transferred continuously and smoothly. In a system including the pressure feeder (transport pump such as a centrifugal pump), air with further high pressure can be used, thereby enabling transfer of further long distance. In a system including at least one mud stirring device provided near the periphery of a lower end portion of the vertical screw conveyor, even relatively hard mud, which cannot be fluidized by means of the inlet device alone, is preliminary-stirred by means of the mud stirring device provided near the periphery of a lower end portion of the vertical screw conveyor, and its fluidity is promoted by means of the inlet device, so that the operation of dredging and transferring can be performed continuously at high density.

A dense dredging and transferring apparatus according to as further feature of the present invention comprises a vertical screw conveyor, a pressure feeder provided at a discharge port of the vertical screw conveyor, a check valve provided at the discharge port of the pressure feeder, a transport pipe provided after the check valve, and a nozzle for introducing compressed air into the transport pipe. This dense dredging and transferring apparatus is adapted to handle soft mud, such as floating mud, having fluidity intrinsically. In this case, the operation of fluidizing the mud is unnecessary, thus an inlet device is not included.

In the case of a pump dredging system, when changing the position of a spud, a pump cannot be stopped even though the efficiency of dredging decreases because of a problem of a transport pipe becoming clogged.

In the dense dredging and transport apparatus of the present invention, the dredging operation ( the vertical screw conveyor ) is independent of the transport operation ( compressed air ); thus, even if the vertical screw conveyor and the pressure feeder are stopped to change the position of the spud, the ejecting operation can be performed at high density without causing clogging, by continuously supplying compressed air through the nozzle to the transport pipe. In this operation, since the check valve is provided on the upstream side of the nozzle, the air cannot move backward or toward the upstream side. Therefore, when clogging the position of the spud, it is possible to stop the vertical screw conveyor and the pressure feeder, whereby no water is taken in.

DESCRIPTION OF THE PREFERRED EMBODIMENTS

Figure 1:
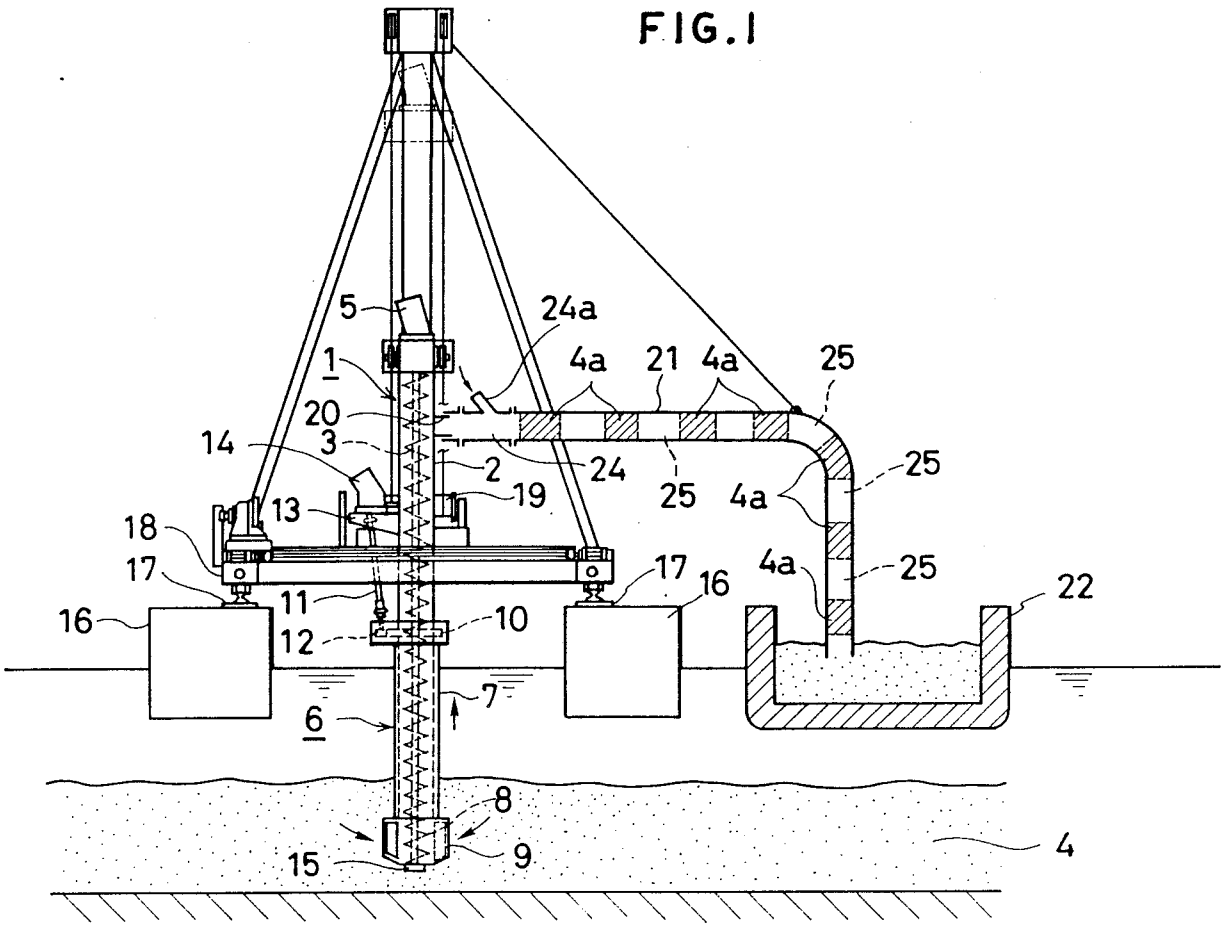
FIGS. 1 and 2 are front view showing embodiments of a dredging apparatus according to the present invention.

The present invention will now be described in greater detail with reference to embodiments shown in the drawings.

In a dredging apparatus shown in FIG. 1, a vertical screw conveyor 1 comprises a cylindrical barrel 2 and a screw 3 disposed rotatably inside the barrel 2, this screw 3 being adapted to send up a soft mud 4 such as sludge. The screw 3 is connected with and rotated by a motor 5 disposed on the upper end side of the barrel 2. Disposed on the distal end side of the vertical screw conveyor 1 is an inlet device 6 for scooping the soft mud 4 into the vertical screw conveyor 1. This inlet device 6 comprises a barrel 7 attached to the distal end of the vertical screw conveyor 1 rotatably about the axial center of the vertical screw conveyor 1, an opening 8 formed in a distal end side portion of the barrel 7, wings 9 provided about the opening 8 which project rearward in the direction of rotation of the barrel, a rack gear 10 provided circumferentially in an upper portion of the barrel 7, a drive shaft 11 extending along the periphery of the barrel 2 of the vertical screw conveyor 1, a pinion gear 12 secured to the lower end of the drive shaft 11 and held in mesh with the rack gear 10, and a motor 14 disposed on a bracket 13 secured to the periphery of the barrel 2 of the vertical screw conveyor 1 which is connected with the upper end of the drive shaft 11. A lower end portion of the screw 3 of the vertical screw conveyor 1 extends into the barrel 7 of the inlet device 6 and is supported rotatably by a bracket 15 provided at the distal end of the barrel 7.

Disposed on both sides of the vertical screw conveyor 1 and the inlet device 6 are box-like flat vessels 16 which are elongate in a direction orthogonal to the plane of the drawing sheet, and a moving truck 18 is seated on guide rails 17 disposed on the upper side of the flat vessels 16, which is movable in a direction orthogonal to the plane of the drawing sheet. This moving truck 18 is configured so as to stretch between the flat vessels 16 located on both sides of the vertical screw conveyor 1 and the inlet device 6. Mounted on the moving truck 18 is a winch 19 for lifting the vertical screw conveyor. A discharge port 20 of the vertical screw conveyor 1 is connected via a transport pipe 24 with an air nozzle or discharge pipe 21, the distal end opening of this discharge pipe 21 being brought in a barge 22. An air intake pipe 24*a* of the transport pipe 24 is connected with a compressor not shown.

The operation will now be described. After the inlet device 6 is put through the soft mud layer ( sludge layer ) 4, the inlet device 6 is rotated by the motor 14 ( in the same or opposite direction to the screw 3 ). As a result, an inner portion of the soft mud 4 is sucked in through the opening 8, vertically fed inside the barrel 2 of the vertical screw conveyor 1 by means of the screw 3, and sent into the discharging pipe 21. The soft mud 4 thus sent into the discharge pipe 21 is changed to a so-called "plug flow" state as illustrated by slanted portions 4*a* in the drawing by mixing a compressed air 25 with the soft mud that is supplied through the transport pipe 24, to that the soft mud is smoothly transferred toward the barge 22.

In this way, this embodiment can suck only the soft mud 4 without taking in sea water.

Figure 2:
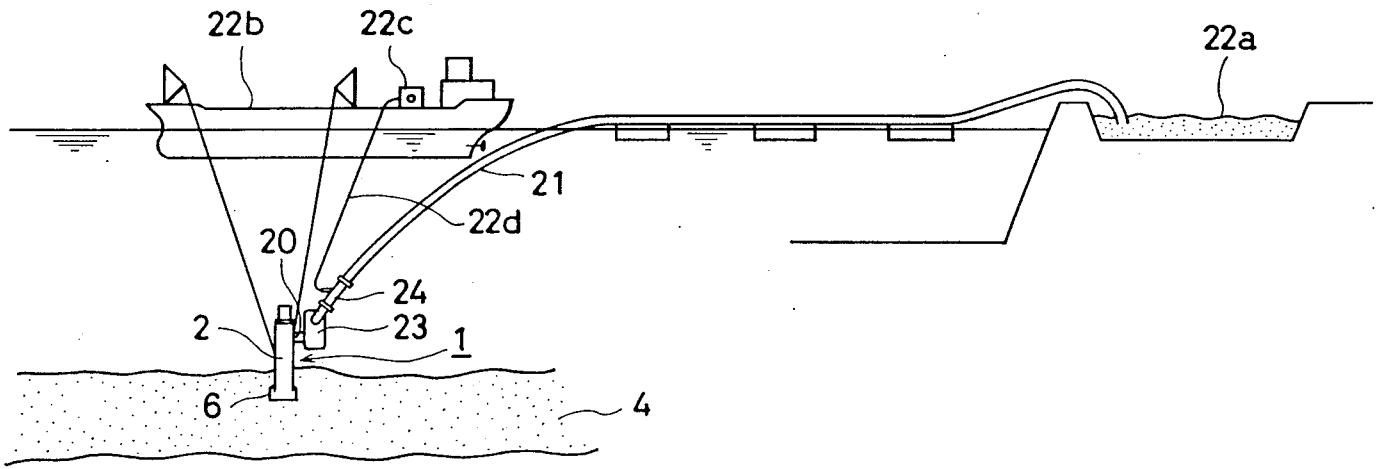

FIG. 2 shows another embodiment of the dredging apparatus according to the present invention, which differs from the above-mentioned embodiment mainly in that a pressure feeder ( a transport pump ) 23 is attached to the portion of the discharge port 20 of the vertical screw conveyor 1 with the transport pipe 24 disposed on the discharge side of the transport pump 23. The transport pump is preferably made of a centrifugal pump. In this way, with the pump 23 and the transport pipe 24 disposed in the vicinity of the discharge port 20 of the vertical screw conveyor 1, it is possible to dredge up high-density soft mud deeply, transfer distantly and send up highly. The soft mud 4 sent up inside the barrel 2 of the vertical screw conveyor 1 is forcibly sent by the transport pump 23 and the transport pipe 24, transferred through the discharge pipe 21 onto the ground, and discarded at a dumping site 22*a*. In FIG. 2, reference numeral 22*b* designates a dredging vessel, and compressed air is supplied from a compressor 22*c* mounted on the dredging vessel to the transport pipe 24 through an air pipe 22*d*.

According to the present invention, the inlet device 6 may be omitted from the dredging apparatus shown in FIG. 2. This apparatus, however, includes the transport pump 23, thus can transfer the soft mud strongly.

Although the foregoing embodiment has been illustrated as transferring the soft mud horizontally, the present invention should not be limited to such an arrangement, but can be applied to a vertical transport system.

A further embodiment of the dredging apparatus is shown in FIGS. 3 through 6. In these drawings, a vertical screw conveyor 31 comprises a cylindrical barrel 32 and a screw 33 disposed rotatably inside the barrel 32, and is adapted to send up soft mud such as sludge by means of the screw 33. The screw 33 is connected with and rotated by a motor ( not shown ) provided on the upper end side of the barrel 32.

The vertical screw conveyor 31 has a plow 35 having the functions of digging and stirring which is attached to the distal end thereof. This plow 35 is coaxial and rotatable with the screw 33, which comprises a rotary sleeve 36 fitted rotatably on the barrel 32, another rotary sleeve 36' identical in diameter with the barrel 32, a roof casing 37 secured to the periphery of the rotary sleeve 36', inner and outer scooping blades 38 and 39 extending downward from the casing 37, and a plurality of screens disposed horizontally and orthogonally to the blades 38 and 39 and spaced vertically at given intervals with rakes 40 attached to their periphery.

Figure 5:
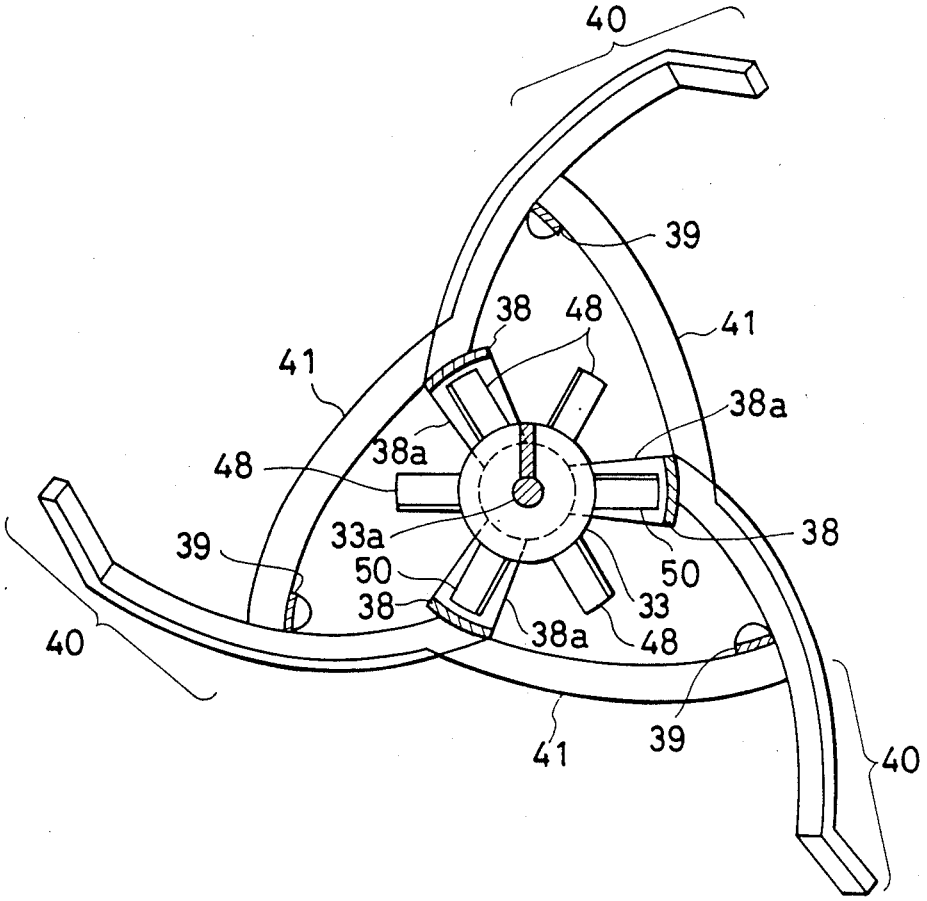
FIG. 5 is a sectional view taken along line V—V of FIG. 2.

As shown in FIG. 5 in greater detail, the inner blades 38 are disposed close to the circumference of stirring paddles 50 provided at the distal end of the screw 33, and connected via radially-extending brackets 38*a* to a bearing block 33A provided at the distal end of the screw 33.

The outer blades 39 are disposed outside the circumference of the inner blades 38, so that in response to the rotation of the inner blades 38 and the outer blades 39, soft mud lying around these blades is taken into the barrel 32.

Figure 4:
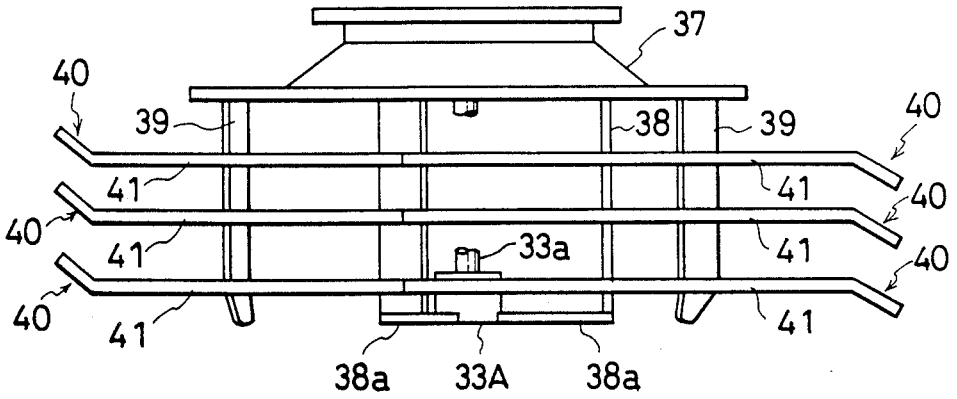
FIG. 4 is an enlarged front view showing a plow.

The screens 41 are adapted to prevent large rocks and foreign matters from entering the barrel 32 through the plow 35, and as shown in FIG. 5, the screens 41 are made of bar screens of substantially triangular shape welded with the blades 38 and 39. As shown in FIG. 4, the distal ends of each rake 40 are slightly bent vertically, so that the screens 41 under rotation achieve a digging function by means of their teeth and prevent the clogging of foreign matters.

Figure 3:
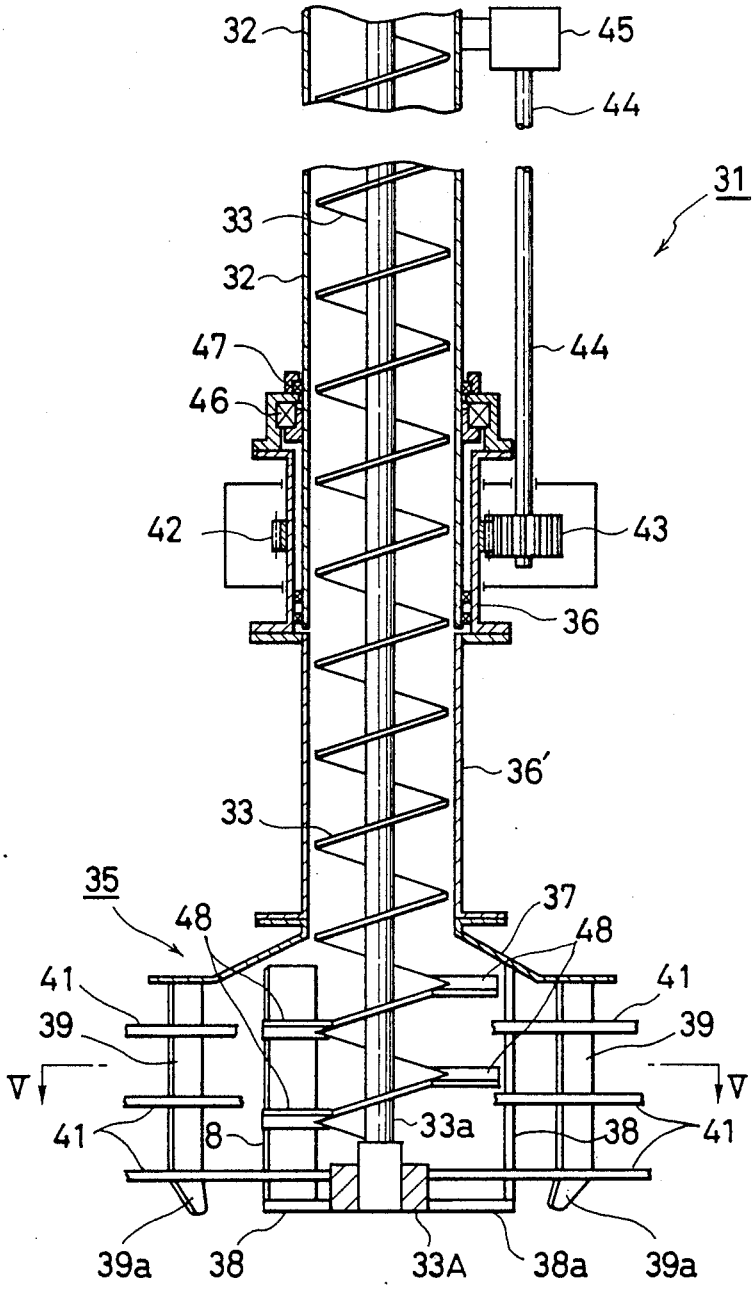
FIG. 3 is a sectional view showing an important portion of a further embodiment of the dredging apparatus according to the present invention.
Figure 6:
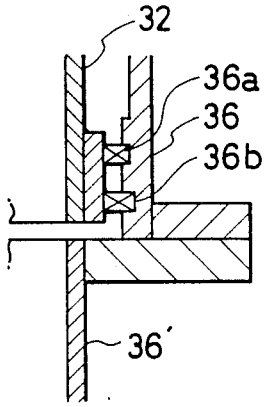
FIG. 6 is a fragmentary enlarged sectional view showing a lower end portion of a barrel.

As shown in FIG. 3, the rotary sleeves 36 and 36' are rotatably disposed coaxially with the barrel 32 of the vertical screw conveyor 31. The rotary sleeve 36 has a rack gear 42 provided on the periphery thereof, and this rack gear 42 is always in mesh with a pinion gear 43. This pinion gear 43 is secured to the lower end of a drive shaft 44 extending along the periphery of the barrel 32. The upper end of this drive shaft 44 is connected with a motor 45 provided on the upper end side of the barrel 32, so that in response to the operation of this motor 45, the rotary sleeve 36 is rotated via the drive shaft 44, pinion gear 43 and rack gear 42. The rotary sleeve 36, rotary sleeve 36' and plow 35 suspended therefrom are supported rotatably by a thrust bearing 46 attached to the barrel 32. As shown in FIG. 6, the barrel 32 has two gland packings 36*a* and 36*b* provided in a lower end portion thereof, so that they, in conjunction with an upper gland packing 47, prevent water from entering the inside of the double sleeve.

On the other hand, a lower portion of the screw 33 below the plow 35 has a plurality of stirring paddles 48 spaced at equal intervals and projecting radially, each stirring paddle 48 being shaped like a flat plate and attached so as to give the same inclination as that of the screw 33.

The operation of the thus configured dredging apparatus will now be described. A drive device of a dredging vessel ( not shown ) is operated, the plow 35 provided at the distal end of the vertical screw conveyor 31 is put through soft mud on the bottom of the water, and a drive device ( not shown ) of the screw 33 and the motor 45 are actuated at the same time. In response to the rotation of the motor 45, the rotary sleeve 36 and the plow 35 are rotated. In response to the rotation of the plow 35, soft mud around the intake portion is stirred and fluidized, and by means of the inner and outer blades 38 and 39, is taken into the barrel 32 through the plow 35. During this operation, foreign matters mixed in the soft mud are prevented from entering the plow 35 by means of the screens 41, and ejected outward along the surfaces of the rakes 40.

On the other hand, the soft mud introduced into the barrel 32 through the plow 35, after being stirred and further fluidized by means of the stirring paddles 48, rises inside the barrel 32 in response to the rotation of the screw 33 and then is discharged through a discharge port ( not shown ) to a given area. For example, the soft mud is discharged from the vertical screw conveyor 31, after being added with a solidifying agent and mixed therewith, is discarded at a dumping site using a carrying vessel, force feed hose, etc.

Where the diameter of the screw 33 is large, the vertical spacing between the screens 41 may be increased. On the other hand, if vertical bars are provided between the screens 41 to change the arrangement of the screens 41 to a gridiron pattern, the entering of far small foreign matters can be prevented.

Figure 7:
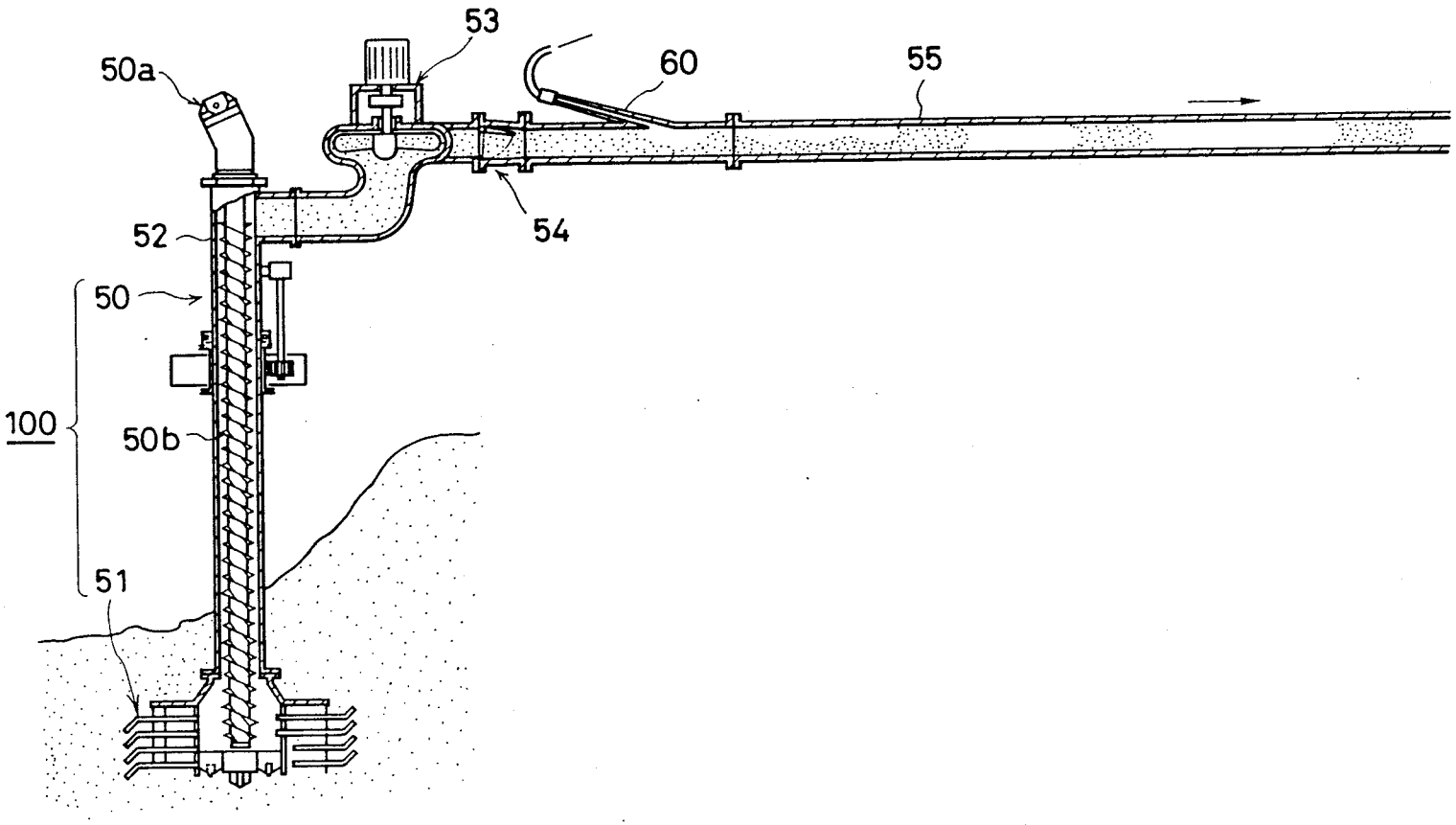
FIG. 7 is a sectional side view showing a further embodiment.

In FIG. 7 showing a further embodiment, 51 is an inlet device, 50 a vertical screw conveyor, 50*a* a screw driving device, 50*b* a screw, 52 a screw sleeve, and 53 a pressure feeder. Although this embodiment uses a centrifugal pump, a squeeze pump may be used. 54 is a check valve which may be made of a gate valve, butterfly valve, knife gate valve, etc. 55 is an ejection pipe which has a nozzle 60 at a midpoint or near to the beginning point thereof that is connected with a compressed air supply device not shown so that compressed air can be introduced continuously.

Figure 8:
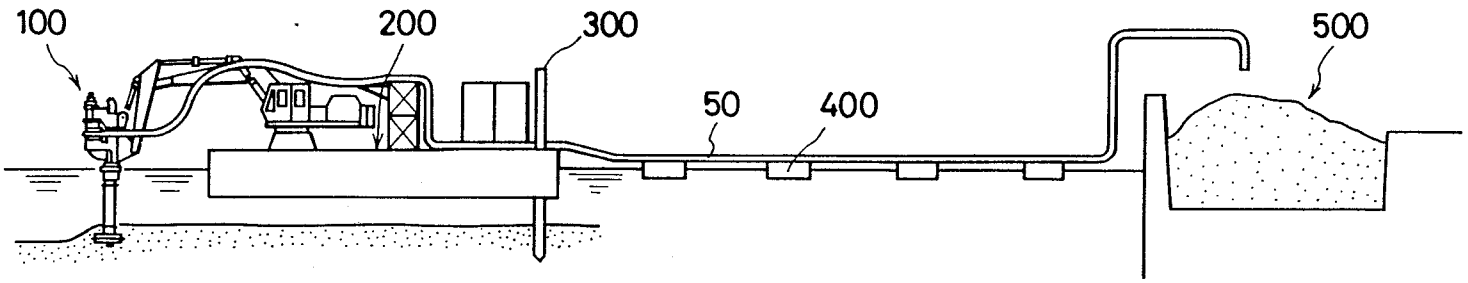
FIG. 8 is a side view showing an application system in which the apparatus of the present invention is mounted on a working vessel.

FIG. 8 shows an application system in which a dredging apparatus 100 composed of the foregoing inlet device 51 and vertical screw conveyor 50 is mounted on a working vessel 200. The soft mud dredged up is sent to a disposal area 500 defined on the ground through the ejection pipe 55 moored to spaced floaters 400 floating on the sea.

Figure 9:
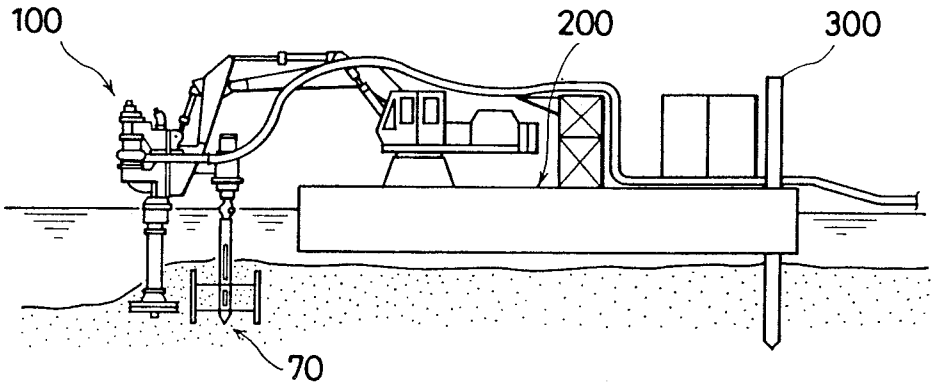
FIG. 9 is a side view showing a further embodiment.

In FIG. 9 showing a further embodiment, a mud stirring device 70 is provided adjacent to the dredging apparatus 100, which performs preliminary stirring before the soft mud is taken in by the inlet device 51. A spud 300 shown in FIGS. 8 and 9 is a pile which is struck in the seabed to set the working position of the working vessel 200.

As shown in FIG. 7, the nozzle 60 for introducing compressed air into the ejection pipe 55 is generally provided at one point immediately after the check valve 54 in order that the soft mud sent from the vertical screw conveyor 52 or the pressure feeder 53 may be transferred to a desired site in the form of "plug flow"; but, where the distance of transfer is very long, a few nozzles are adequately distributed along the ejection pipe to enhance a transferring faculty and prevent the clogging of the ejection pipe.

The vertical screw conveyor 50 and the inlet device 51 are similar in structure to those shown in FIGS. 3 through 5.

Figure 13:
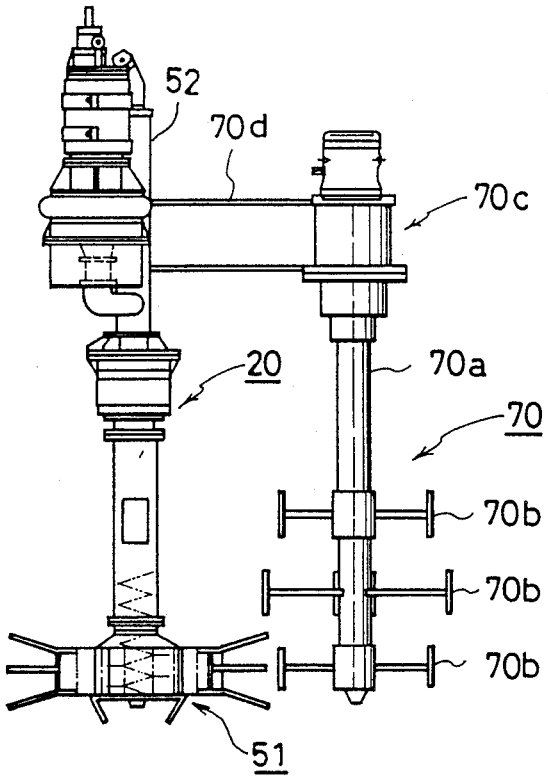
FIG. 13 is a side view showing an embodiment of a mud stirring device.
Figure 14:
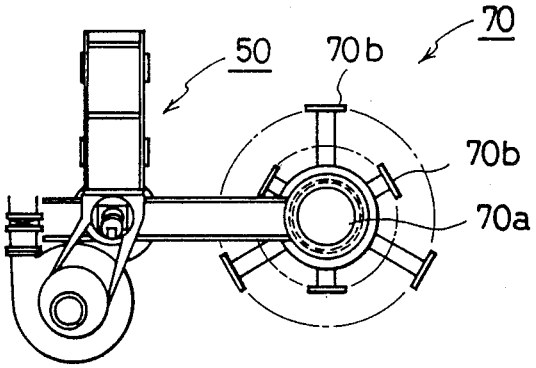
FIG. 14 is a plan view of the above.

As shown in FIGS. 13 and 14, the mud stirring device 70 comprises a rotary shaft 70*a* extending downward to which a plurality of vanes are attached in axially disposed away from each other. The rotation of the rotary shaft is attained by a hydraulic motor or water-proof electric motor 70*c* provided thereabove. The hydraulic motor or electric motor 70*c* is secured via a support 70*d* to the vertical screw conveyor 52, and in response to the stirring operation of the vanes 70*b* of the mud stirring device 70, the soft mud is readily taken into the inlet device 51.

On the other hand, the check valve 54 is used to prevent the soft mud ( to be transferred toward the downstream side ) from moving toward the upstream side under the influence of the compressed air ( generally, of 5 to 7.5 $Kg/cm^2G$ ) introduced through the nozzle 60, thus to prevent the occurrence of difficulty in transfer, that is, it acts as a nonreturn valve.

According to the dense dredging and transporting apparatus thus configured of the present invention, the soft mud on the seabed is readily taken into the vertical screw conveyor with the aid of the inlet device and/or the mud stirring device provided adjacent thereto and without taking in surplus water. The mud is sent upward inside the barrel under the aid of the rotating screw, charged into the transport pipe, and transferred by compressed air while being prevented from flowing backward to a distant object site while forming "plug flow". Where the apparatus includes the pressure feeder, the soft mud can be reliably sent up to the nozzle portion. Especially, where a large volume of water compared with the soft mud is sent to the dredging apparatus, even if the dredging apparatus is stopped, the soft mud inside the transport pipe can be transferred up to an object site without stopping its movement.

Figure 10:
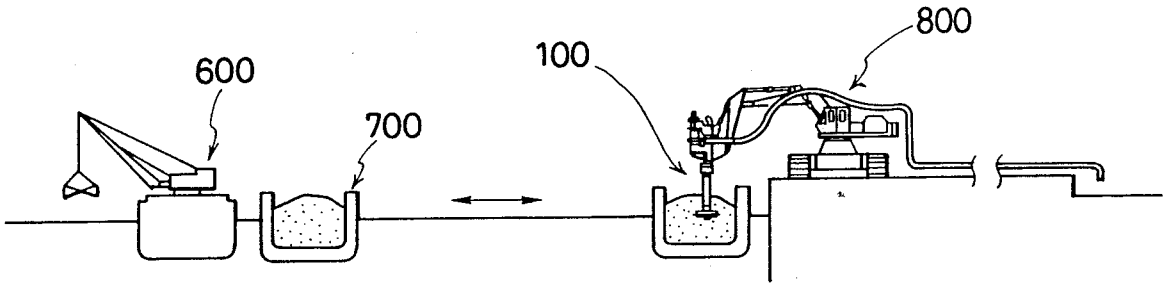
FIG. 10 is a side view showing another application system in which the apparatus of the present invention is used at a pier in connection with a sediment carrying vessel loaded fully with soft mud.

In the system of FIG. 10, a sediment carrying vessel 700 loaded fully with the soft mud collected by a grab dredging vessel 600 sails up to a pier, and the soft mud is transferred to an object site by means of the apparatus of the present invention mounted on an unloader 800 situated at a pier.

Figure 11:
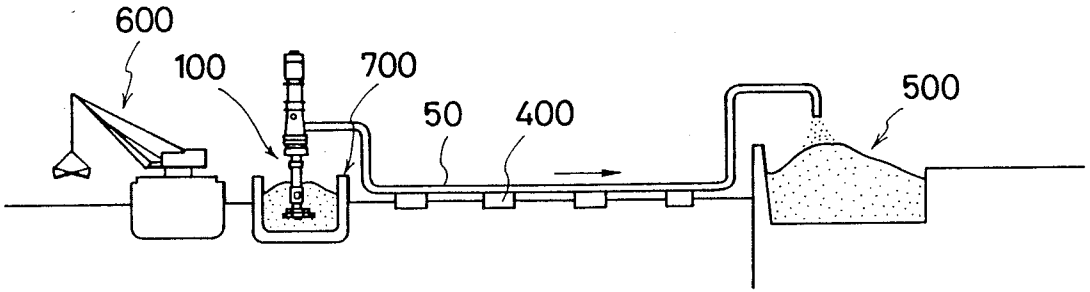
FIG. 11 is a side view showing a further application system in which the apparatus of the present invention is use with a sediment carrying vessel in the vicinity of a grab dredging vessel.
Figure 12:
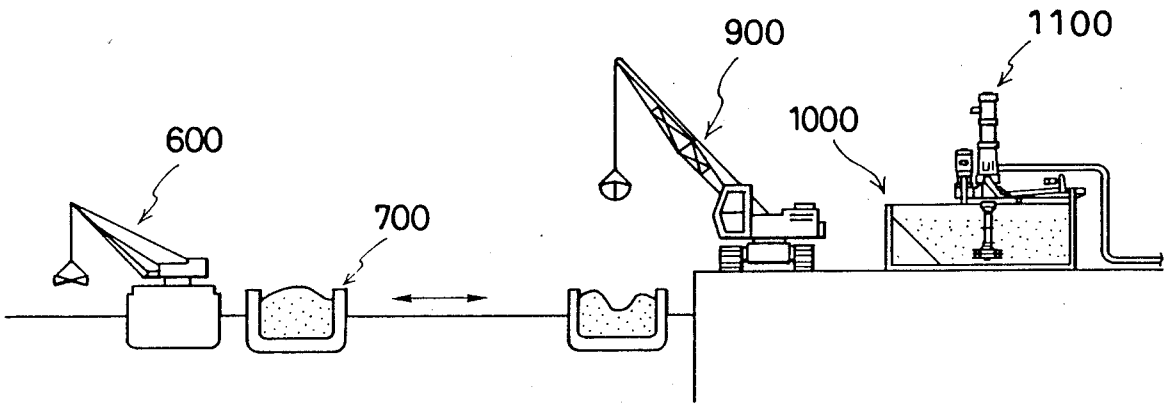
FIG. 12 is a side view showing a further application system in which the apparatus of the present invention is used with a mud storage tank into which mud is transferred from a sediment carrying vessel coming alongside a pier by means of a landing device ( of the clamshell type )

In the system of FIG. 11, the apparatus is mounted on the sediment carrying vessel 700 and operated with the sediment vessel non-plying between the offing and the pier. In the system of FIG. 12, the soft mud thrown in a mud storage tank 1000 from the sediment carrying vessel 700 transferred to the pier by means of a landing device ( for example, a clamshell type construction machine ) 900 is ejected by the apparatus of the present invention acting as an ejecting device 1100.

The apparatus shown in FIG. 7 from which the inlet device 51 is removed also belongs to the present invention. This arrangement is used where the degree of solidity of soft mud is not severe so that the soft mud can be readily taken into the vertical screw conveyor.

What is claimed is:

1. A dredging apparatus comprising a vertical screw conveyor having a lower end side and a discharge port, an inlet device provided rotatably on the lower end side of said vertical screw conveyor, a check valve provided at the discharge port of said screw conveyor, a pressure feeder provided between said discharge port of said vertical screw conveyor and said check valve, a transport pipe provided on the discharged side of said check valve, and a nozzle for introducing compressed air into said transport pipe.

2. A dredging apparatus according to claim 1, further including at least one mud stirring device provided near the periphery of a lower end portion of said vertical screw conveyor.

3. A dredging apparatus comprising a vertical screw conveyor, a pressure feeder provided at the discharge port of said vertical screw conveyor, a check valve provided at the discharge port of said pressure feeder, a transport pipe provided after said check valve, and a nozzle for introducing compressed air into said transport pipe.

4. A dredging apparatus comprising, a vertical screw conveyor including a cylindrical barrel having a lower end and a discharge port, a screw situated inside the cylinder barrel and having a lower end portion, and first means for rotating the screw, an inlet device including a rotary sleeve rotationally connected to the lower end of the cylindrical barrel and having a lower end, said screw extending through the rotary sleeve, second means for rotating the rotary sleeve, a plurality of scooping blades attached to the lower end of the rotary sleeve, said scooping blades extending parallel to the longitudinal direction of the rotary sleeve, and screens attached to the scooping blades perpendicularly thereto, and a plurality of stirring paddles attached to the lower end portion of the screw inside the scooping blades and the screens so that soft mud stirred by the scooping blades and stirring paddles is conveyed through the inlet device and vertical screw conveyor to discharge from the discharge port.

5. A dredging apparatus according to claim 4, further comprising, a transport pipe attached to the discharge port of the vertical screw conveyor, and a nozzle attached to the transport pipe, said nozzle introducing compressed air into the transport pipe to transfer soft mud with water inside the transport pipe.

6. A dredging apparatus according to claim 5, further including a transport pump provided between said discharge port of said vertical screw conveyor and said transport pipe.

* * * * *